US005275222A

United States Patent [19]

Jelic et al.

[11] Patent Number: 5,275,222

[45] Date of Patent: Jan. 4, 1994

[54] CORD LOCK AND RELEASE SYSTEM FOR BLINDS

[75] Inventors: Ralph Jelic, Valencia, Pa.; Ren Judkins, 46 Newgate Rd., Pittsburgh, Pa. 15202

[73] Assignee: Ren Judkins, Pittsburgh, Pa.

[21] Appl. No.: 853,490

[22] Filed: Mar. 18, 1992

[51] Int. Cl.[5] ..... E06B 9/324

[52] U.S. Cl. ..... 160/178.2; 24/134 R

[58] Field of Search ..... 160/178.2, 168.1, 173; 24/134

[56] References Cited

U.S. PATENT DOCUMENTS

| | | | |
|---|---|---|---|
| 950,952 | 3/1910 | Perrott | 24/134 KB |
| 1,036,232 | 8/1912 | Hedberg | 24/134 R |
| 2,087,865 | 7/1937 | Walker | 160/178.2 X |
| 3,191,644 | 6/1965 | Hurkmans . | |
| 3,221,602 | 12/1965 | Hurkmans . | |
| 3,294,153 | 12/1966 | Fountain | 160/178.2 X |
| 3,455,365 | 7/1969 | Stall | 160/178.2 X |
| 3,633,646 | 1/1972 | Zilver | 160/168.1 |
| 3,727,665 | 4/1973 | Debs | 160/178.2 |
| 3,799,236 | 3/1974 | Debs | 160/178.2 |
| 3,931,846 | 1/1976 | Zilver | 160/178.2 |
| 4,245,688 | 1/1981 | Vecchiarelli . | |
| 4,347,885 | 9/1982 | von Knorring et al. . | |
| 4,413,664 | 11/1983 | Istha . | |
| 4,443,915 | 4/1984 | Niemeyer . | |
| 4,646,898 | 3/1987 | Anderson . | |
| 4,660,612 | 4/1987 | Anderson . | |

*Primary Examiner*—David M. Purol

*Attorney, Agent, or Firm*—Buchanan Ingersoll; Lynn J. Alstadt

[57] ABSTRACT

A cord lock and release system for use in a window blind assembly. The system has a stationary member and a movable member. The movable member is positioned so that at least one lift cord can move across a portion of the movable member when the movable member is in an open position. The lift cords will be restrained by frictional contact with the movable and stationary members when the movable member is in a locked position. The movable member is biased towards a locked position. A release linkage is attached to the movable member so that when a force is applied to the linkage the movable member is moved toward the open position.

28 Claims, 3 Drawing Sheets

CORD LOCK AND RELEASE SYSTEM FOR BLINDS

BACKGROUND OF THE INVENTION

1. Field of the Invention

This invention relates generally to a cord lock and release system for a window blind assembly. More particularly, the invention relates to a cord lock and cord release system capable of being actuated independent of the positioning of the cords.

2. Description of the Prior Art

Window blind assemblies are typically operated by having one or more lift cords being connected at one end to the window blinds and having the other end which extends out of the blinds being accessible to the operator. The window blinds are typically raised by the operator pulling on the accessible portion of the lift cords and are lowered by allowing the weight of the shade to pull the lift cords back into the blind. When the operator has moved the blind to a desired position, the lift cords must be held in place so that the blind will remain in the chosen position after the operator has let go of the lift cords. For this reason, the art has developed various types of cord locking devices. Some cord locks such as those disclosed in U.S. Pat. No. 4,443,915 to Niemeyer employ a cam-like tumbler and others such as those shown in U.S. Pat. No. 4,660,612 to Anderson have a jaw-like cord lock structure. To operate these types of cord locks, some secondary movement of the lift cords other than in and out of the blind is required. For example, to lock and to unlock the device of Niemeyer, the operator must move the lift cords transversely either upwards or downwards across an inclining surface. In order to operate the device of Anderson, the operator must move the lift cords away from the plane of the blind assembly. Often, because of the location of the blind assembly in a room or because of furnishings in the room, movement of the lift cords in the manner required in the prior art is very difficult. It is also confusing to the operator because different products might require different secondary movements of the lift cords as in the above examples and it is not obvious to the operator which motion is correct.

SUMMARY OF THE INVENTION

We provide a cord lock and release system for use in a blind assembly that utilizes one or more lift cords to effectuate the raising or lowering of the blinds. The cord lock and release system automatically locks or prevents one or more lift cords from returning into the blind. The operator can release the lift cords via a direct mechanical linkage. The cord lock and release system employs a cord valve through which the lift cords are disposed. The cord valve has a spring or other means of bias to always allow the lift cords to pass out of the blind, but prevent them from returning. The cord lock and release system also has a linkage that is connected to the cord valve such that pulling or moving the linkage overcomes the spring bias and allows the lift cords to travel freely in either direction through the cord valve. The speed at which the lift cords travel through the cord valve is also controlled by an adjustable drag which can be applied either at the linkage or at the cord valve.

In a first preferred embodiment of the cord lock and release system, the cord valve is a planar slide plate cooperating with a stationary housing. The slide plate has a cord opening through which the lift cords are disposed. The planar slide plate further has a spring connected to it. Immediately adjacent and parallel to the planar slide plate is a stationary housing that also has an opening. The stationary housing is fixed to the blind assembly so that it does not move relative to the blind assembly. When no release force is applied to the cord valve, the spring biases the planar slide plate to be positioned in relation to the stationary housing such that the planar slide plate opening and the stationary housing opening are offset from one another. Because of the positioning of the stationary housing in relation to the planar slide plate, the lift cords are firmly held by the gripping contact of the slide plate and the stationary housing on the lift cords. The planar slide plate and the stationary housing are both preferably tapered so that the tapered-outward portions of each may more firmly grip the cords. Thus held, the cords are unable to travel into the blind and the blind is prevented from being lowered. The operator is always able, however, to raise the blinds by pulling the lift cords out of the blind. When the cords are thus gripped, the cord valve is said to be in a closed, locked position. In the locked position, the weight of the blind is held by the spring. A linkage is attached to the planar slide plate such that when the linkage is pulled an external force is applied to the planar slide plate opposing the spring bias causing the planar slide plate opening and the stationary housing opening to move toward alignment. When the planar slide plate opening and the stationary housing opening are thus aligned, the cord valve is said to be in an open position. In the open position, there is no longer any gripping contact of the plate and housing acting on the lift cords and the lift cords are permitted to move freely through the cord valve. The amount of gripping contact of the plate and housing on the lift cords can be varied by varying the amount of external force applied to the linkage. When the linkage no longer has an external force applied to it, the spring biases the cord valve back to a locked position.

In a second embodiment of the cord lock and release system, the cord valve has a pivotable cam-like tumbler cooperating with an intermediary surface and a stationary surface. The stationary surface is fixed to the blind assembly and is thus prevented from moving. The lift cords are disposed between a distal clamp portion of the tumbler and the intermediary surface. When no external forces are applied to the cord valve, the clamp portion of the tumbler is biased towards the intermediary surface and stationary surface. This biasing can be by any preferred means such as by gravity or preferably by a spring. An intermediary plate preferably made of an elastomeric material is placed between the lift cords and the stationary surface to distribute the point of impingement of the tumbler on the cords over a greater area and to reduce the relative motion between the lift cords and the stationary surface during locking and releasing of the lift cords. Thus, in this embodiment, the spring forces the tumbler into a position where the motion and friction of the lift cords on the tumbler pull the tumbler into a jammed position with the intermediary surface. The lift cords are disposed between the tumbler clamp portion and the intermediary surface and are gripped. When the cords are thus gripped, the cords are prevented from traveling into the blind which prevents the blind from being lowered. The operator can always raise the blind by causing the lift cords to travel out of the blinds as the cord valve only prevents the lift cords from traveling into the blind. A linkage is attached to the tumbler such that when the linkage is pulled, an external force is applied to the tumbler opposing the spring bias. This external force causes the clamp portion of the tumbler to be moved away from the intermediary and stationary surfaces. When the clamp portion of the tumbler is thus separated from the intermediary surface, the cord valve is said to be in an open position. In the open position, there is no longer any gripping of the tumbler and the intermediary surface on the lift cords, and the lift cords are thus permitted to move freely through the cord valve. The amount of gripping contact of the tumbler and intermediary surface on the lift cords can be varied by varying the amount of external force applied to the linkage. Once the linkage is released, the spring biases the tumbler back into contact with the lift cords. When the tumbler is in contact with the lift cords, the distal surface of the tumbler is moved closer to the stationary surface as the lift cords are pulled into the blind and through the cord valve by the weight of the blind. The distal portion will eventually reach such a proximity to the stationary surface that the lift cords will be gripped and prevented from moving further into the blind. When the lift cords are thus gripped, the cord valve is in a locked position.

DESCRIPTION OF THE PREFERRED EMBODIMENT

In a blind assembly in which the blinds or shades are connected to an end of one or more lift cords and are moved by repositioning the other end of the lift cords that extends out of the blind, the present cord lock and release system allows the lift cords to be freed from a locked position so that their position may be adjusted by pulling a linkage and their position may be locked by releasing the linkage. This is accomplished without the need to manipulate the lift cords.

Figure 1:
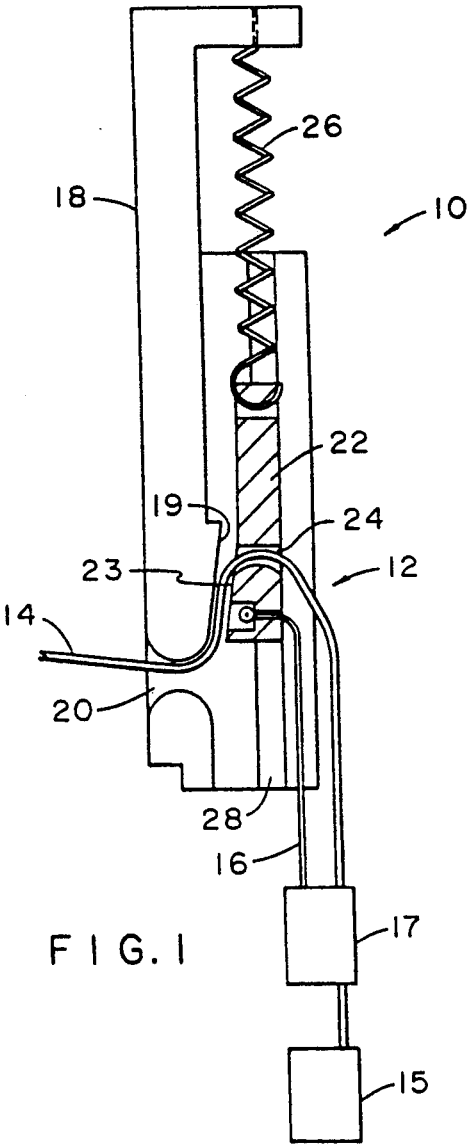
FIG. 1 is a longitudinal cross-sectional view of a first preferred cord lock and release system in a closed position.

Referring first to FIG. 1, a first preferred embodiment of a cord lock and release system 10 is shown for use in a blind assembly. The cord lock and release system 10 has a cord valve 12, through which at least one and usually two or more lift cords pass. For ease of illustration, only one cord 14 is shown in the drawings. A linkage 16 is connected to the cord valve 12. Cord valve 12 has a stationary housing 18 that is secured to the blind assembly and is thus prevented from moving. Stationary housing 18 has an opening 20 through which lift cord 14 is disposed. A planar slide plate 22 is situated in a plane that is adjacent to and parallel to stationary housing 18. Planar slide plate 22 has an opening 24 through which at least one cord 14 passes. A spring 26 is connected by any convenient means at one end to planar slide plate 22 and at its opposite end to a post that may extend from stationary housing 18 or the blind apparatus. Spring 26 is preferably an extension spring and is connected to planar slide plate 22 by any convenient means such as by fashioning a hook into the final turn of spring 26 and placing the hook through a hole in planar slide plate 22.

Figure 2:
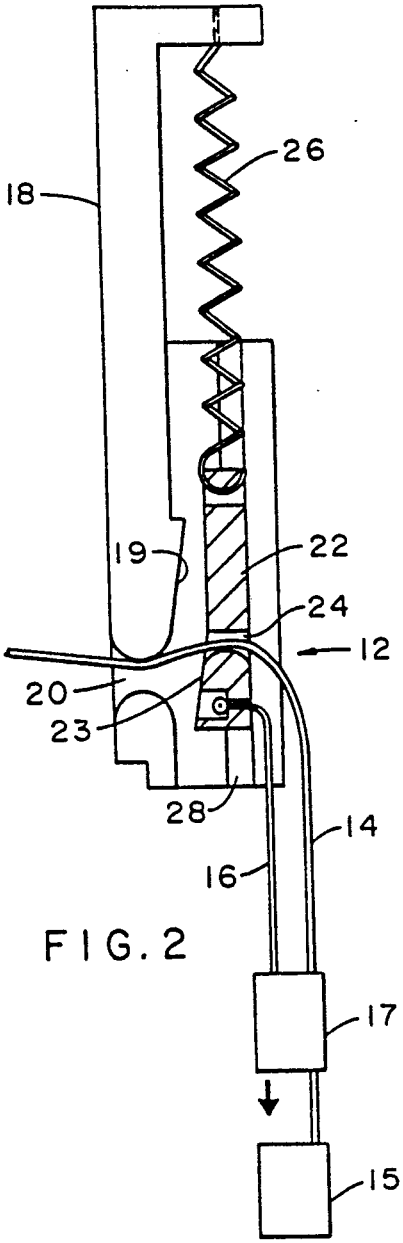
FIG. 2 is a cross-sectional view similar to FIG. 1 showing the first preferred cord lock and release system in an open position.

When no external forces are acting on planar slide plate 22, spring 26 is in a contracted state which biases planar slide plate 22 into a predetermined offset or closed position relative to stationary housing 18, as shown in FIG. 2. Thus, a portion of planar slide plate 22 that bounds planar slide plate opening 24 is forced by spring 26 into contact with lift cord 14. This bounding portion of planar slide plate 22 is preferably smooth and formed without sharp edges. Planar slide plate 22 is preferably formed with a taper 23 along a surface of planar slide plate 22 that faces stationary housing 18. The portion of planar slide plate 22 that is tapered is adjacent to planar slide plate opening 24 and most proximate to stationary housing opening 20 when cord valve 12 is in the closed or locked position. The planar slide plate taper 23 extends angularly outward toward stationary housing 18 and downward away from spring 26. Lift cord 14 is then forced, by planar slide plate 22, into contact with a portion of stationary housing 18 that bounds stationary housing opening 20. This bounding portion of stationary housing 18 is also preferably smooth and formed without sharp edges that may damage lift cord 14. Stationary housing 18 is preferably formed with a taper 19 along the surface of stationary housing 18 that faces planar slide plate 22. The portion of stationary housing 18 that is tapered is adjacent to stationary housing opening 20 and nearest to planar slide plate opening 24 when cord valve 12 is in the closed or locked position. The stationary housing taper 19 extends angularly outward toward planar slide plate 22 and upward toward spring 26. The contact between planar slide plate 22, stationary housing 18 and lift cord 14 acts to grip lift cord 14 and prevent lift cord 14 from moving through stationary housing opening 20 and planar slide plate opening 24 and into the blind. Thus gripped, the blind is prevented from being covered. This gripping contact is made more effective by the stationary housing taper 19 moving towards planar slide plate taper 23. Therefore, when no external forces are acting on planar slide plate 22, and planar slide plate 22 is returned to its predetermined, spring-biased position, lift cord 14 is prevented from travel through the cord valve 12 into the window blind. Cord valve 12 is thus returned to its closed or locked position.

At least some portion of planar slide plate 22 is preferably situated within a track 28. Track 28 allows planar slide plate 22 and stationary housing 18 to remain at a fixed distance from one another and allows planar slide plate 22 to move in a plane that is parallel to stationary housing 18. The track can be provided in the sides 30 of the blind headrail (not shown) or sides attached to stationary housing 18. A linkage 16 is connected to planar slide plate 22 by any convenient means such as by gluing, tying or placing linkage 16 through a hole in planar slide plate 16 and placing a knot in the end of linkage 16 that is larger than the hole. The linkage is preferably a cord, but could also be assembled from one or more rigid members. The linkage 16 has a handle 17 attached to it by any convenient means which is accessible to the operator. The linkage handle 17 could hang freely from the linkage or be within or attached to the frame of a window to which the blind having our cord lock and release system is mounted.

Referring to FIG. 2, when the operator pulls linkage handle 17, linkage 16 is pulled and a force (shown by bold arrow in FIG. 2) acts on planar slide plate 22. This force acting on planar slide plate 22 causes planar slide plate 22 to move transverse and in a plane parallel to stationary housing 18 extending spring 26. As planar slide plate 22 is moved by linkage 16, the amount of offset between planar slide plate opening 24 and stationary housing opening 20 is reduced which reduces the amount of gripping on lift cord 14. If a sufficient force is applied at linkage 16, planar slide plate 22 is moved along track 28 to a position in which stationary housing opening 20 and planar slide plate opening 24 will be sufficiently aligned so that there is no longer any gripping contact between planar slide plate 22, stationary housing 18 and lift cord 14. When the lift cord 14 is no longer in sufficient gripped contact with the planar slide plate 22 and stationary housing 18 to keep lift cord 14 firmly held, the lift cord 14 is able to be freely moved through stationary housing opening 20 and planar slide plate opening 24. Then, cord valve 12 is said to be in an open position. Thus, when the weight of the blind provides a force on lift cord 14, lift cord 14 may be repositioned either slowly or quickly by simply applying an appropriate amount of force to linkage 16. The greater the amount of force on linkage 16, the more quickly lift cord 14 will travel through the cord valve 12. Thus, the amount of restriction on lift cord 14 may be varied directly by the amount of force applied to linkage 16 on cord valve 12. When linkage 16 is released, so that no external force is applied to planar slide plate 22, spring 26 will return to its contracted state. Cord valve 12 will thus be returned to a closed, locked position, and lift cord 14 will be locked in place.

The operator may cause the lift cord 14 to travel out of the blind, thus raising the blind whether the cord valve is in the locked or open position. In the open position, the lift cord is free to move in either direction. When the cord valve is in the locked position, a pulling force exerted on the lift cord 14 will pull planar slide plate 22 into a sufficiently open position so that lift cord 14 will travel out of the blind.

Figure 3:
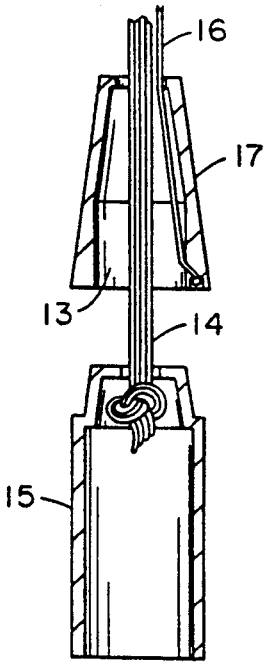
FIG. 3 is a front cross-sectional view of the preferred lift cord and weighted lift cord handle cooperating with the preferred linkage and linkage handle.

In addition to being capable of varying the restriction of the lift cord 14 by varying the release force exerted at cord valve 12, the restriction of lift cord 14 could be varied at linkage handle 17. As seen in FIG. 3, linkage handle 17 is preferably a rigid member having an opening through it. The portion of lift cord 14 that extends out of the blind is placed through linkage handle opening 13. As the operator pulls linkage handle 17, lift cord 14 begins traveling through linkage handle opening 13 from the weight of the blind pulling the lift cord 14 into the blind. When the linkage handle 17 is tilted so that friction is felt between the lift cord 14 and the material around the linkage handle opening 13, the rate of travel of lift cord 14 will be slowed. Thus, the restriction of lift cord 14 is variable at linkage handle 17.

The lift cord 14 is provided with a weighted, tassel-like handle 15 attached by any convenient means to the end of lift cord 14 that is opposite to the end of lift cord 14 attached to the blind. Weighted lift cord handle 15 is weighted so that lift cord 14 will remain taut at all times and for any operation of the cord lock and release system. The weighting of weighted lift cord handle 15 is sufficient to keep lift cord 14 taut but is less than the amount of weight needed to overcome the biasing of cord valve 12 towards the locked position. Thus, when the window blind assembly is in the raised position and an external force is applied to linkage 16, lift cord 14 will travel through linkage handle 17 through cord valve 12 and into the blind as the blind is lowered. Weighted lift cord handle 15 will act as a stop such that when weighted lift cord handle 15 contacts linkage handle 17, lift cord 14 will be prevented from moving further into the blind and when the linkage handle 17 is released the cord valve will immediately close or lock and the blind will be prevented from being lowered further. The weighted lift cord handle 15 allows the lift cord length within the blind and therefore the length of the blind to be easily adjusted. By adjusting the position of weighted lift cord handle 15 relative to the headrail, the length of the lift cord 14 that can enter the blinds before weighted lift cord handle 15 contacts linkage handle 17 is adjusted, which determines the amount by which the blinds can be lowered.

Figure 4:
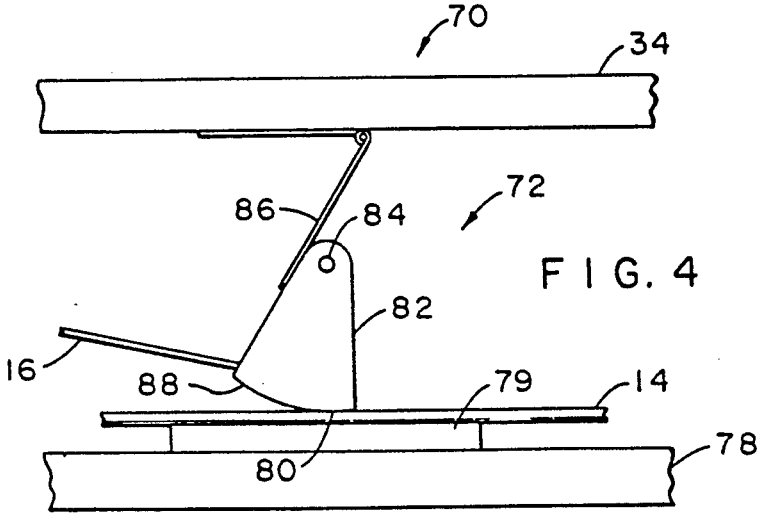
FIG. 4 is a side view of a second preferred cord lock and release system.

Referring next to FIG. 4, a second preferred embodiment of a cord lock and release system 70 is shown for use in a blind assembly. The cord lock and release system 70 has a cord valve 72, a lift cord 14 disposed through the cord valve 72 and a linkage 16 connected to the cord valve 72. Cord valve 72 has a cam-like tumbler 82 rotationally fixed to a tumbler pivot 84. Tumbler 82 has a preferable curved portion 88 that is distal to tumbler pivot 84. A stationary surface 78 that is fixed to the blind assembly and is thus prevented from moving lies below tumbler 82. An intermediary surface 79 that is made preferably of an elastomeric material is placed between the tumbler 82 and stationary surface 78. Intermediary surface 79 is preferably placed upon but not fixed to stationary surface 78 so that intermediary surface 79 may translate across stationary surface 78 when subjected to a force. A spring 86 is fixed by any convenient means to the blind assembly 34 at one end and is connected to the tumbler 82 at its opposite end. Spring 86 may contact tumbler 82 or may be fixed to tumbler 82 by any convenient means. Spring 86 is designed such that when no external forces are acting on tumbler 82, spring 86 is in an extended state. In this extended state,, spring 86 biases tumbler 82 so that tumbler clamp portion 88 contacts intermediary surface 79. Cord 14 is disposed between tumbler clamp portion 88 and intermediary surface 79. When tumbler clamp portion 88 is biased into contact with intermediary surface 79, cord 14 is gripped and is prevented from moving into the window blind which prevents the window blind from being lowered. Also, since intermediary surface 79 is made of an elastomeric material and since intermediary surface 79 is supported by stationary surface 78 which is rigid, intermediary surface 79 will compress slightly when pressure is applied from tumbler 82. As intermediary surface 79 deforms, lift cord 14 will be held by a greater surface area of intermediary surface 79 and tumbler 82, thus improving the gripping. By not fixing intermediary surface 79 to stationary surface 78 so that intermediary surface 79 can move slightly, when lift cord 14 is dragged across it with sufficient pressure from tumbler 82, the relative movement and thus the abrasion between lift cord 14 and intermediary surface 79 are reduced. This is because intermediary surface 79 and lift cord, 14 move in the same direction as the tumbler clamp portion 88 is moved into gripping contact with the moving lift cord 14. By moving in the same direction, there is less relative movement between the lift cord 14 and intermediary surface 79 which results in less friction and thus less wear of lift cord 14. In the same way, the relative movement and wear are reduced between the lift cord 14 and the intermediary surface 79 when the lift cord 14 is moved out of the window blind enough to begin moving through the cord valve. Thus, when no release force is acting on tumbler 82, cord 14 is restrained from moving into the blind and cord valve 72 is said to be in a closed, locked position.

A linkage 16 is connected to tumbler 82 by any convenient means such as by gluing or tying. The linkage is preferably a cord, but could also be assembled from one or more rigid members. When linkage 16 is pulled, an applied release force causes tumbler 82 to rotate about tumbler pivot 84. That rotation causes tumbler clamp portion 88 to move away from intermediary surface 79 contracting spring 86. When tumbler clamp portion 88 is not in sufficient biased contact with intermediary surface 79, lift cord 14 is able to travel into the window blind, allowing the blind to be lowered. In this state, cord valve 72 is said to be in an open position. As tumbler 82 is moved by linkage 16, the amount of rotation of tumbler 82 is increased which reduces the amount of gripping contact on lift cord 14. Thus, the amount of restriction on lift cord 14 may be varied directly by the amount of force applied at linkage 16. When linkage 16 is released, so that no release force is applied to tumbler 82, spring 86 will return to its extended state. Cord valve 72 will thus be returned to a closed, locked position. In the locked position, lift cord 14 will be prevented from moving into the blind which prevents the blind from being lowered.

The operator may cause the lift cord 14 to travel out of the blind, thus raising the blind whether the cord valve is in the locked or open position. In the open position, the lift cord is free to move in either direction. When the cord valve is in the locked position, a pulling force exerted on the lift cord 14 will cause tumbler 82 to rotate away from clamping contact with the lift cord 14 allowing the lift cord to travel out of the blind.

Figure 7:
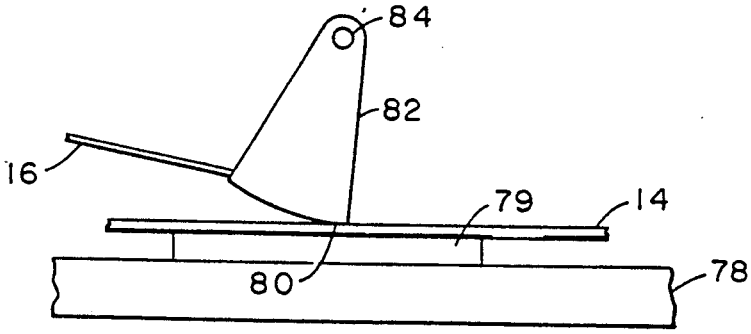
FIG. 7 is a side view of a variation of the second preferred cord lock and release system in which the tumbler is gravity-biased towards the intermediary surface.

Tumbler 82 can be biased towards intermediary surface 79 and lift cord 14 by means other than a separate spring 86. For example as shown in FIG. 7, gravity will bias tumbler clamp portion 88 to extend toward intermediary surface 79 when the cord lock and release system is oriented so that intermediary surface 79 is located below tumbler pivot 84. With tumbler clamp portion 88 in this gravity-biased position, frictional contact will occur between tumbler clamp portion 88 and lift cord 14 as lift cord 14 travels into the blind. The frictional contact between tumbler clamp portion 88 and lift cord 14 pulls tumbler 82 further towards intermediary surface 79 until lift cord 14 is gripped between tumbler clamp portion 88 and intermediary surface 79. In this gripped, locked position, lift cord 14 is unable to travel further into the blind. However, in the locked position, lift cord 14 is able to travel out of the blind since cord travel in this direction will result in frictional contact between the lift cord 14 and tumbler clamp portion 88 that will tend to move tumbler clamp portion 88 away from the intermediary surface 79. To release lift cord 14, the operator would apply a force to linkage 16 so that tumbler clamp portion 88 would pivot away from intermediary surface 79.

When the cord lock and release system is oriented so that intermediary surface 79 is not below tumbler pivot 84, a spring may be employed to bias tumbler clamp portion 88 towards intermediary surface 79. In this variation, the lift cord 14 is not held by spring-exerted gripping but rather the spring allows tumbler 82 to be in a position where the motion and friction of lift cord 14 on tumbler clamp portion 88 as lift cord 14 travels into the blind pulls tumbler 82 further towards intermediary surface 79 and into gripped contact with lift cord 14.

Figure 5:
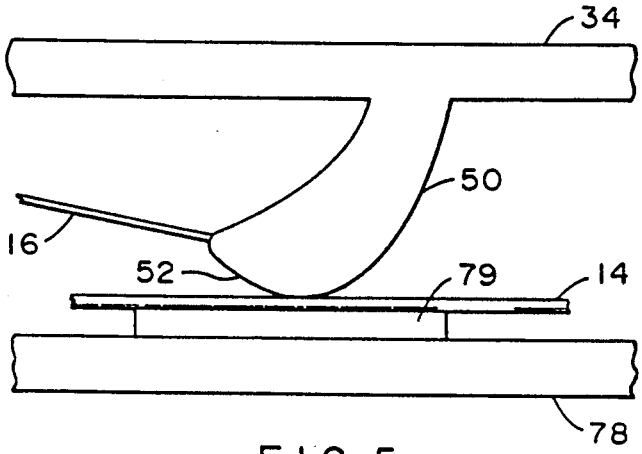
FIG. 5 is a side cross-sectional view of a variation of the second preferred cord lock and release system having a non-pivotable tumbler made of a resilient material.

Furthermore, as shown in FIG. 5, a separate spring and pivotable tumbler could be replaced by a one-piece tumbler 50 molded of a resilient material. The one-piece tumbler 50 would be fixed at one end to a stationary portion of the window blind assembly and would have a distal end 52 extend toward intermediary surface 79. Thus, the positioning of the one-piece tumbler 50 and the flexure of the resilient tumbler material will bias the one-piece tumbler 50 towards intermediary surface 79. When lift cord 14 moves into the blind between the one-piece tumbler 50 and the intermediary surface 79, the flexure of the resilient material as well as the frictional contact between the tumbler distal end 52 and the lift cord 14 will cause the distal end 52 to move further toward intermediary surface 79. The one-piece tumbler 50 will flex to accommodate any movement at the tumbler distal end 52. A linkage 16 would be provided at the one-piece tumbler 50 to move the distal end 52 away from the intermediary surface 79 when the operator desires to lower the window blinds.

Regardless of the design or orientation of the cord valve or the means chosen to bias the cord valve, an independent linkage is provided which, when activated by the operator, counters the bias and allows the cord valve to be placed into an open position.

This linkage preferably has a handle attached to it by any convenient means which is accessible to the operator. The linkage handle could hang freely from the linkage or be within or attached to the frame of a window to which the blind having our cord lock and release system is mounted. Thus, by pulling the linkage handle, the operator can apply a force to the linkage.

Thus, for each method of locking the lift cord, the restriction of the lift cord can be varied by varying the release force on the linkage. The restriction of the lift cord could also be varied at the linkage handle. In FIG. 3, the linkage handle is preferably a rigid member having an opening through it. The portion of lift cord 14 that extends out of the blind is placed through the linkage handle opening. Thus, as the lift cord travels through the linkage handle opening, the linkage handle can be tilted or positioned so that the lift cord will rub against the linkage handle material around the opening. This contact between the lift cord and the linkage handle will create friction which will slow the travel of the lift cord.

Figure 8:
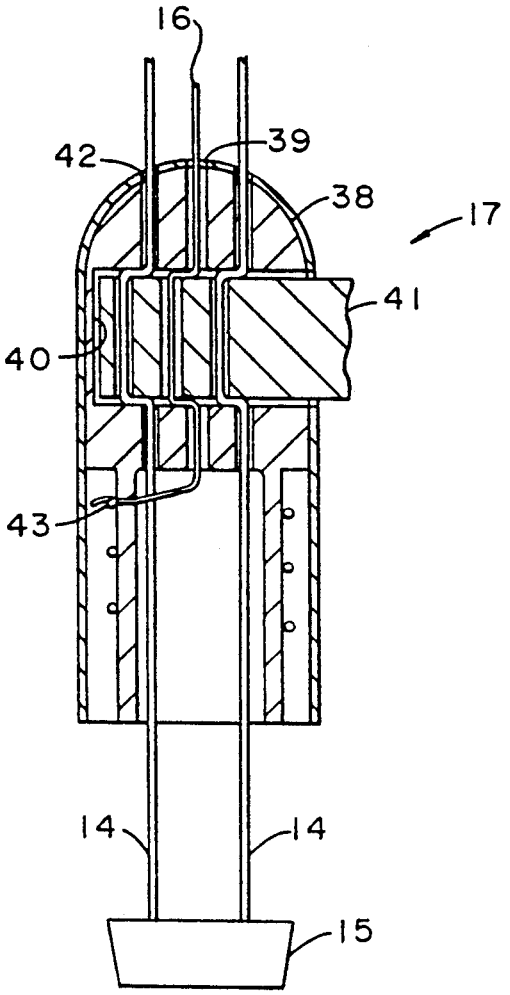
FIG. 8 is a front cross-sectional view of the linkage handle and the lift cord handle.

An alternative means of varying the restriction of the lift cord at the linkage handle is shown in FIG. 8. Linkage handle 17 has a handle body 38 having a linkage passage 39 disposed through it. Handle body 38 further has lift cord passages 42 disposed through it. Handle body 38 further has a button cavity 40 disposed through it. A button 4 is disposed within button cavity 40. Button 41 also has a linkage passage and lift cord passage 42 disposed through it. When button 41 is put into a restraining position as shown in FIG. 8, the lift cord passages 42 of the handle body 38 and button 41 will be offset which will cause the lift cords to be gripped between the button and the handle body. When pressure is removed from button 41, the tension in the lift cords will cause button 41 to be moved away from the restraining position. The linkage will be disposed through the linkage passages and will be adjustably fixed around a portion of the handle body by any convenient means such as by tying a knot 43 into the end of the linkage. Lift cord 14 is connected to lift cord handle 15 by any means, such as by tying a knot at the end of the cord (not shown). Although two lift cord passages 42 are shown any number of passages to accommodate any number of lift cords could be used.

Figure 9:
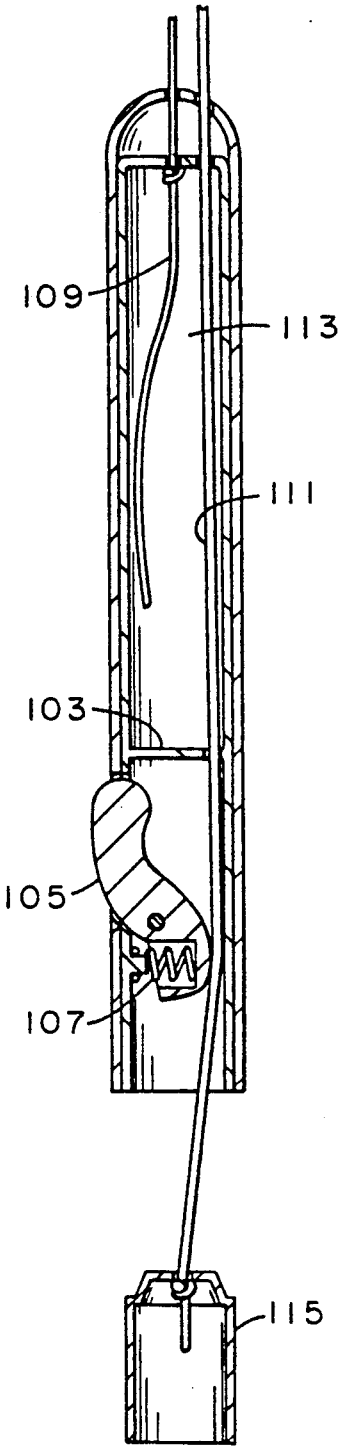
FIG. 9 is a front cross-sectional view of another variation of the linkage handle and the lift cord handle.

Another alternative means of varying the restriction of the lift cord at the linkage handle is shown in FIG. 9. A cam button 105 may be rotatably disposed within linkage handle 103. Cam button 105 is biased by a spring 107 toward contact with the interior wall of the linkage handle 103. The lift cord 111 is disposed between the cam button and the wall of the linkage handle and fixed to lift cord handle 115 by any convenient means such as by tying a knot in the end of the lift cord. Linkage 109 is connected to linkage handle 113 by any convenient means. By pressing cam buttom 105, the cam button will rotate away from the wall of the linkage handle which will cause the lift cord not to be restricted within the linkage handle.

The lift cord will also have a handle attached by any convenient means to the end of the lift cord which extends out of the blind. As the lift cord travels through the linkage handle and into the blind lowering the blind, the weighted lift cord handle will eventually contact the linkage handle. When the weighted lift cord handle contacts the linkage handle, the blinds will be prevented from being lowered further.

Figure 6:
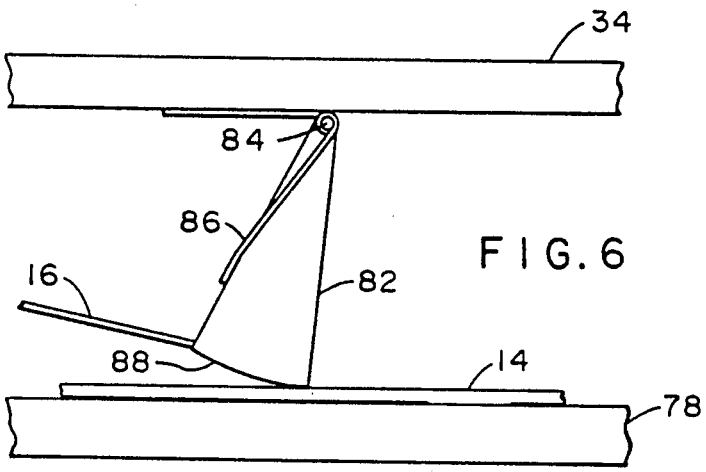
FIG. 6 is a side view of a variation of the second preferred cord lock and release system in which tumbler contact is made directly to the stationary surface.

Variations of the preferred embodiments could be made. For example, as shown in FIG. 6, the cam-like valve of the second preferred embodiment need not utilize an intermediary surface. Thus, lift cord 14 would be held between tumbler 82 and stationary surface 78 when in the locked position.

Also, although a coil spring 26 is employed to bias the cord valve 12 of the first preferred embodiment, any type of spring could be used if properly positioned on the valve. Similarly, although a coil spring 86 is used to bias cord valve 72, any type of spring could be used.

Furthermore, for any spring-loaded, gripping embodiment such as the first preferred embodiment, the stationary and movable plates need not move linearly relative to one another. The movable plate could be pivotably attached to the stationary plate so as to allow rotational movement of the movable plate.

And, tumbler 82 could also be mounted to provide a guillotine type action in which the entire tumbler would move through a plane which intersects the stationary surface 78. An example of this variation would be a roller in a track capable of moving linearly.

Also, although tumbler clamp portion 88 of cord valve 72 is preferably smooth and curved, it may have serrations for additional gripping.

It is understood that although one lift cord has been described for ease of description, any number of lift cords may be employed in the blind assembly in which the cord lock and release system is used.

While certain present preferred embodiments have been shown and described, it is distinctly understood that the invention is not limited thereto but may be otherwise embodied within the scope of the following claims.

We claim:

1. A cord lock and release system in combination with a window blind assembly, the window blind assembly having lift cords that connect at one end to window blinds, extend through an upper, fixed portion of the window blind assembly and have an opposite end accessible to an operator, the cord lock and release system comprising:

(a) a stationary member secured to the upper, fixed portion of the window blind assembly;

(b) a movable member sized and positioned so that a portion of at least one lift cord can move across a portion of the stationary member and a portion of the movable member when the movable member is in an open position and the lift cord will be restrained by frictional contact with both members when the movable member is in a locked position;

(c) means for biasing the movable member toward a locked position; and (d) an elongated flexible linkage, one end of the linkage being accessible to the operator, and an opposite end of the linkage being attached to the movable member so that as an external force is applied to the linkage, the movable member is moved toward the open position.

2. The cord lock and release system of claim 1 wherein the means for biasing the movable member to a locked position is a spring secured at one end to the fixed portion of the blind assembly and at an opposite end to the movable member.

3. The cord lock and release system of claim 1 wherein the means for biasing the movable member to a locked position is a gravitational force acting on the movable member.

4. The cord lock and release system of claim 1 wherein the stationary member and the movable member are parallel plates each having a hole through which the at least one cord passes.

5. The cord lock and release system of claim 4 wherein the movable member is movable in a transverse direction relative to the stationary member.

6. The cord lock and release system of claim 1 wherein the movable member is pivotably attached to the fixed portion of the window blind assembly to allow rotational movement of the movable member.

7. The cord lock and release system of claim 6 wherein a clamping portion of the movable member that contacts the lift cord has a rounded surface.

8. The cord lock and release system of claim 1 wherein the movable member is mounted for movement through a path which intersects the stationary member and is positioned to clamp at least one cord between a clamping portion of the movable member and the stationary member.

9. The cord lock and release system of claim 8 wherein the movable member is mounted for pivotable movement through the path.

10. The cord lock and release system of claim 8 wherein the movable member is mounted for linear movement through the path.

11. The cord lock and release system of claim 1 wherein the movable member is mounted for movement through a path which intersects an intermediary member that is placed between the movable member and the stationary member, the movable member is further positioned to clamp at least one cord between a clamping portion of the movable member and the intermediary member.

12. The cord lock and release system of claim 11 wherein the intermediary member is comprised of a resilient material.

13. The cord lock and release system of claim 11 wherein the intermediary member is comprised of a polyurethane.

14. The cord lock and release system of claim 11 wherein the movable member is mounted for pivotable movement through the path.

15. The cord lock and release system of claim 11 wherein the movable member is mounted for linear movement through the path.

16. The cord lock and release system of claim 1 wherein the movable member is made of a resilient material and is fixed to the blind assembly so that movement of the movable member is effectuated by flexure of the moveable member.

17. The cord lock and release system of claim 1 further comprising an elongated handle attached to the linkage at some distance from the movable member.

18. The cord lock and release system of claim 17 wherein the linkage handle has an opening through which one end of each lift cord is disposed.

19. The cord lock and release system of claim 18 wherein the handle has a means of providing adjustable friction drag on the lift cords.

20. The cord lock and release system of claim 18 further comprising a handle to which the end of each lift cord disposed through the linkage handle is adjustably connected.

21. The cord lock and release system of claim 20 wherein the lift cord handle is weighted.

22. The cord lock and release system of claim 21 wherein each lift cord is variably restricted by the linkage handle.

23. The cord lock and release system of claim 22 wherein the restriction is activated by a button.

24. The cord lock and release system of claim 11 wherein the intermediary member is a flat section of material.

25. The cord lock and release system of claim 24 wherein the intermediary member is placed flush against the stationary member and is capable of movement relative thereto.

26. A cord lock and release system in combination with a window blind assembly, the window blind assembly having at least one lift cord that are each connected at one end to window blinds, extend through an upper, fixed portion of the window blind assembly and have an opposite end accessible to an operator, the cord lock and release system comprising:

a first member mounted upon the fixed portion of the window blind assembly;

a second member movably mounted upon the fixed portion of the window blind assembly, the second member being sized and positioned so that a portion of each lift cord can move across a portion of the stationary member and a portion of the movable member when the movable member is in an open position, and the lift cord will be restrained by frictional contact with both members when the movable member is in a locked position;

means for biasing the movable member toward the locked position;

an elongated flexible linkage, one end of the linkage being attached to the movable member so that as an external pulling force is applied to the linkage, the movable member is moved toward the open position; and a handle flexibly attached to the linkage at some distance from the movable member, the linkage handle having an opening through which one end of each lift cord is disposed.

27. The cord lock and release system of claim 26 further comprising a means located in the handle for providing adjustable friction drag on the lift cords.

28. The cord lock and release system of claim 26 wherein the flexible linkage is adjustably connected to the handle.

* * * * *

UNITED STATES PATENT AND TRADEMARK OFFICE

CERTIFICATE OF CORRECTION

PATENT NO. : 5,275,222

DATED : January 4, 1994

INVENTOR(S) : RALPH JELIC, REN JUDKINS

It is certified that error appears in the above-indentified patent and that said Letters Patent is hereby corrected as shown below:

On the Title Page, Item [56];
References Cited, change "3,191,644" to 3,191,664.

Signed and Sealed this

Twelfth Day of July, 1994

*Attest:*

Bruce Lehman

BRUCE LEHMAN

*Attesting Officer*

*Commissioner of Patents and Trademarks*